US010522074B2

(12) United States Patent
Li et al.

(10) Patent No.: US 10,522,074 B2
(45) Date of Patent: Dec. 31, 2019

(54) EMISSION DRIVING CIRCUIT, DISPLAY DEVICE AND DRIVING METHOD OF SHIFT REGISTER

(71) Applicant: Shanghai Tianma AM-OLED Co., Ltd., Shanghai (CN)

(72) Inventors: Yue Li, Shanghai (CN); Renyuan Zhu, Shanghai (CN); Dongxu Xiang, Shanghai (CN); Yana Gao, Shanghai (CN); Xingyao Zhou, Shanghai (CN); Gaojun Huang, Shanghai (CN); Yilin Xu, Shanghai (CN); Zhonglan Cai, Shanghai (CN); Juan Zhu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/131,088

(22) Filed: Sep. 14, 2018

(65) Prior Publication Data

US 2019/0304358 A1 Oct. 3, 2019

(30) Foreign Application Priority Data

Mar. 28, 2018 (CN) ..... 2018 1 0262757

(51) Int. Cl.
*G09G 3/3225* (2016.01)

(52) U.S. Cl.
CPC ... *G09G 3/3225* (2013.01); *G09G 2310/0286* (2013.01); *G09G 2310/0289* (2013.01)

(58) Field of Classification Search
CPC ..... G09G 3/3225; G09G 2310/0289; G09G 2310/0286; G09G 3/3208; G11C 19/28
See application file for complete search history.

(56) References Cited

U.S. PATENT DOCUMENTS

2009/0135991 A1* 5/2009 Chen ..... G11C 19/184 377/79
2010/0188385 A1* 7/2010 Boiko ..... G09G 3/3677 345/211
2010/0328281 A1* 12/2010 Okada ..... G11C 19/184 345/206
2012/0038609 A1* 2/2012 Chung ..... G09G 3/003 345/211
2012/0294411 A1* 11/2012 Duan ..... G09G 3/3233 377/64

(Continued)

*Primary Examiner* — Abhishek Sarma
(74) *Attorney, Agent, or Firm* — Tarolli, Sundheim, Covell & Tummino LLP

(57) ABSTRACT

The present disclosure provides a shift register, a driving method of the shift register, an emission driving circuit, and a display device. The shift register includes a first node control module, a second node control module and an output control module. A first low level signal VGL1 provides low level at a first node, and a high level signal provides high level at a second node. The output control module includes a transistor for outputting low level, so that an output terminal outputs a third low level signal. The first low level signal VGL1, the third low level signal VGL3 and a threshold voltage Vth1 of the transistor in the output control module satisfy a relation of VGL3>VGL1+|Vth1|, such that in a phase following the output terminal outputting the high level signal, the output terminal completely outputs the third low level signal.

16 Claims, 10 Drawing Sheets

(56) References Cited

U.S. PATENT DOCUMENTS

2014/0119492 A1* 5/2014 Liu ..... G11C 19/28
377/64
2015/0255170 A1* 9/2015 Liang ..... G09G 3/3241
377/75

* cited by examiner

EMISSION DRIVING CIRCUIT, DISPLAY DEVICE AND DRIVING METHOD OF SHIFT REGISTER

CROSS-REFERENCE TO RELATED APPLICATIONS

The present application claims priority to Chinese Patent Application No. 201810262757.6, filed on Mar. 28, 2018, the content of which is incorporated herein by reference in its entirety.

TECHNICAL FIELD

The present disclosure relates to display technology, and more particularly, to an emission driving circuit, a display device and a driving method of a shift register.

BACKGROUND

With the rapid development of the flat panel display technology, an Organic Light Emitting Display (OLED for short) has more and more applications due to its excellent characteristics such as self-luminescence, high brightness, wide viewing angle, and rapid response.

In order to drive an organic light-emitting device in the OLED to emit light, the organic light-emitting display panel includes an emission driving circuit. The emission driving circuit includes a plurality of cascaded shift registers. The circuit structure of the shift register and the corresponding operating sequence are shown in FIGS. 1 and 2. FIG. 1 is a circuit structure diagram of a shift register provided in the related art, and FIG. 2 is an operating sequence diagram of a shift register provided in the related art.

It has been found that the shift register cannot output low level completely in the next phase after outputting a high level signal, thereby leading to a falling step in the output wave and thus affecting normal output of the shift register.

SUMMARY

The present disclosure provides an emission driving circuit, a display device and a driving method of a shift register, aiming to avoid occurrence of a falling step during the output of the shift register, thereby ensuring the normal output of the shift register.

In a first aspect of the present disclosure, an emission driving circuit, including a shift register, is provided. The shift register includes: a first node control module electrically connected to an input signal terminal, a first low level signal terminal, a first clock signal terminal, a second clock signal terminal and a high level signal terminal, and configured to control a level at a first node based on an input signal, a first low level signal, a first clock signal, a second clock signal and a high level signal; a second node control module electrically connected to a second low level signal terminal, the first clock signal terminal, the second clock signal terminal, a third clock signal terminal, the high level signal terminal and the first node, and configured to control a level at a second node based on a second low level signal, the first clock signal, the second clock signal, a third clock signal, the high level signal and the level at the first node; and an output control module electrically connected to the high level signal terminal, a third low level signal terminal, the first node and the second node, and configured to control an output terminal to output the high level signal or a third low level signal based on the high level signal, the third low level signal, the level at the first node and the level at the second node. The output control module comprises a transistor for outputting a low level, and the transistor is a PMOS transistor having a control terminal electrically connected to the first node, a first terminal electrically connected to the third low level signal terminal and a second terminal electrically connected to the output terminal. When the first low level signal provides a low level at the first node and the high level signal provides a high level at the second node, the low level at the first node controls the transistor to output a low level in the output control module such that the output terminal outputs the third low level signal. The first low level signal, the third low level signal and a threshold voltage of the transistor for outputting low level in the output control module satisfy a relation that the third low level signal is greater than a sum of the first low level signal and an absolute value of the threshold voltage, such that in a phase following the output terminal outputting the high level signal, the output terminal completely outputs the third low level signal.

In a second aspect of the present disclosure, a display device is provided. The display device includes an emission driving circuit. The emission driving circuit includes a first signal line, a second signal line, and a plurality of cascaded shift registers. Each shift register of the plurality of cascaded shift registers includes: a first node control module electrically connected to an input signal terminal, a first low level signal terminal, a first clock signal terminal, a second clock signal terminal and a high level signal terminal, and configured to control a level at a first node based on an input signal, a first low level signal, a first clock signal, a second clock signal and a high level signal; a second node control module electrically connected to a second low level signal terminal, the first clock signal terminal, the second clock signal terminal, a third clock signal terminal, the high level signal terminal and the first node, and configured to control a level at a second node based on a second low level signal, the first clock signal, the second clock signal, a third clock signal, the high level signal and the level at the first node; and an output control module electrically connected to the high level signal terminal, a third low level signal terminal, the first node and the second node, and configured to control an output terminal to output the high level signal or a third low level signal based on the high level signal, the third low level signal, the level at the first node and the level at the second node. The output control module comprises a transistor for outputting a low level, and the transistor is a PMOS transistor having a control terminal electrically connected to the first node, a first terminal electrically connected to the third low level signal terminal and a second terminal electrically connected to the output terminal. When the first low level signal provides a low level at the first node and the high level signal provides a high level at the second node, the low level at the first node controls the transistor for outputting a low level in the output control module in such a manner that the output terminal outputs the third low level signal. The first low level signal, the third low level signal and a threshold voltage of the transistor for outputting low level in the output control module satisfy a relation that the third low level signal is greater than a sum of the first low level signal and an absolute value of the threshold voltage, such that in a phase following the output terminal outputting the high level signal, the output terminal completely outputs the third low level signal. The first clock signal terminal of a shift register at each odd-numbered stage of the plurality of cascaded shift registers and the second clock signal terminal of a shift register at each even-numbered stage of the plurality of cascaded shift registers are both electrically connected to the first signal line. The second clock signal terminal of a shift register at each odd-numbered stage of the plurality of cascaded shift registers and the first clock signal terminal of a shift register at each even-numbered stage of the plurality of cascaded shift registers are both electrically connected to the second signal line.

In a third aspect of the present disclosure, a driving method of a shift register is provided. The driving method is applicable in the emission driving circuit according to the first aspect of the present disclosure. The driving method includes:

in a first phase when the input signal is at a high level, the first clock signal is at a low level, the second clock signal is at a high level and the third clock signal is at a low level, providing, by the first node control module, a high level at the first node, providing, by the second node control module, a high level at the second node, and maintaining, by the output control module, the output terminal at a low level outputted in a previous phase;

in a second phase when the input signal is at a low level, the first clock signal is at a high level, the second clock signal is at a low level and the third clock signal is at a high level, maintaining, by the first node control module, the first node at the high level in the first phase, providing, by the second node control module, a low level at the second node, and controlling, by the output control module, the output terminal to output the high level signal;

in a third phase when the input signal is at the low level, the first clock signal is at a low level, the second clock signal is at a high level and the third clock signal is at a low level, providing, by the first node control module, a low level at the first node, providing, by the second node control module, a high level at the second node, and controlling, by the output control module, the output terminal to completely output the third low level signal; and in a fourth phase when the input signal is at a low level, the first clock signal is at a high level, the second clock signal is at a low level and the third clock signal is at a high level, maintaining, by the first node control module, the first node at the low level in the third phase, providing, by the second node control module, a high level at the second node, and maintaining, by the output control module, the output terminal at the low level outputted in the third phase.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings without any creative effort.

DESCRIPTION OF EMBODIMENTS

In order to better understand technical solutions of the present disclosure, the embodiments of the present disclosure are described in details with reference to the drawings. It should be clear that the described embodiments are merely part of the embodiments of the present disclosure rather than all of the embodiments. All other embodiments obtained by those skilled in the art without paying creative labor shall fall into the protection scope of the present disclosure.

Figure 3:
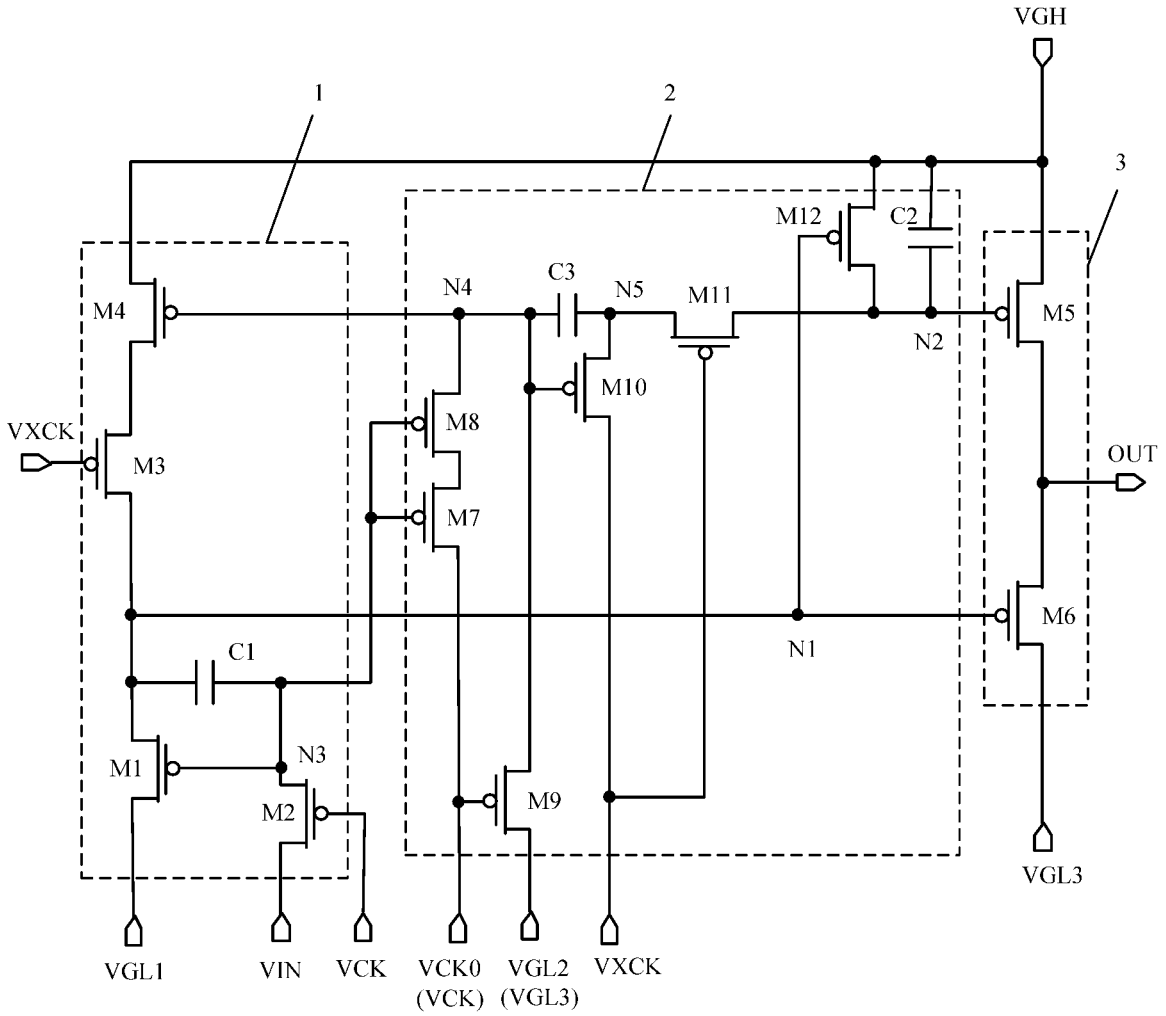
FIG. 3 is a circuit structure diagram of a shift register according to an embodiment of the present disclosure.
Figure 4:
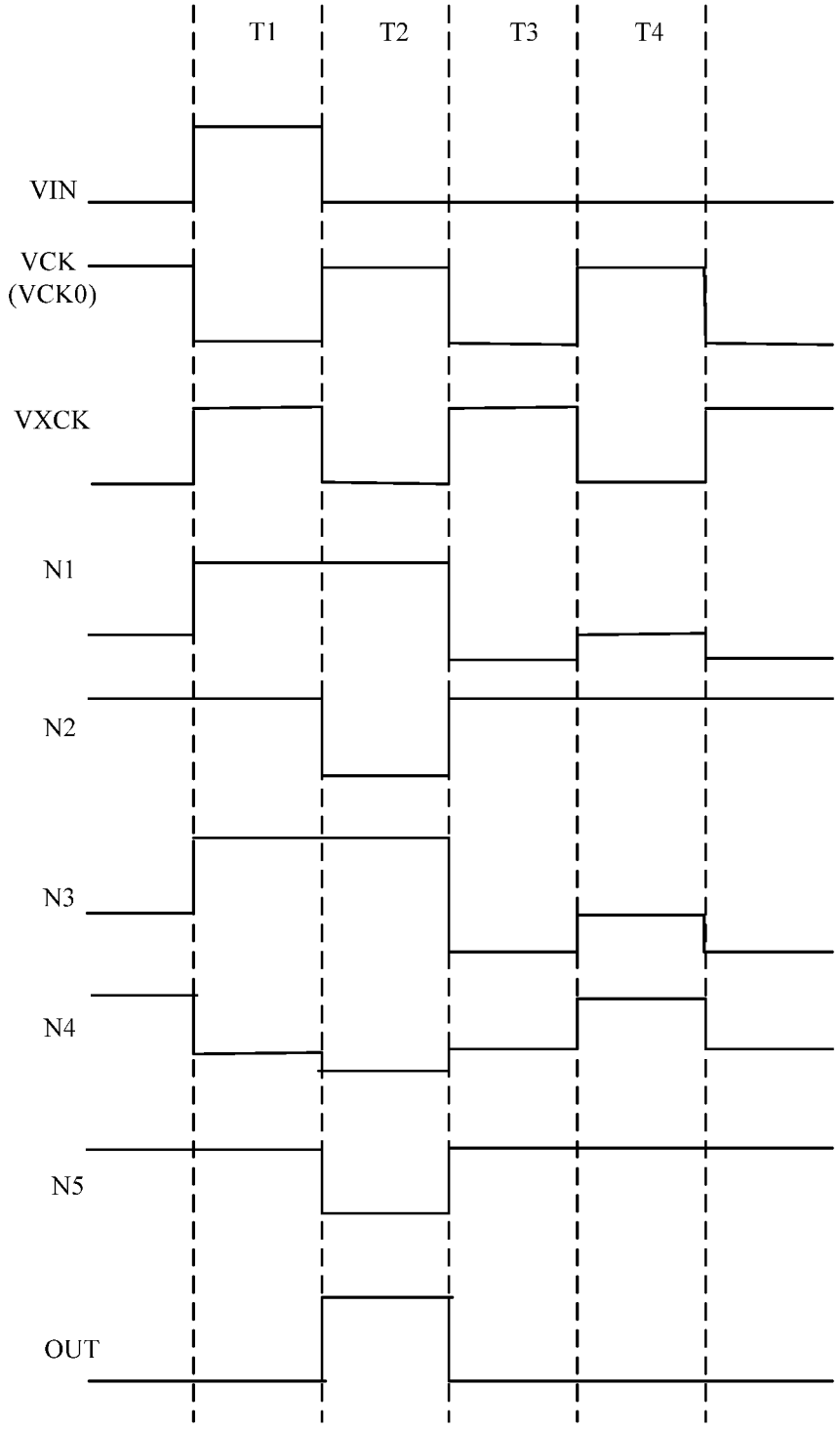
FIG. 4 is an operating sequence diagram of the shift register shown in FIG. 3 according to an embodiment of the present disclosure.
Figure 5:
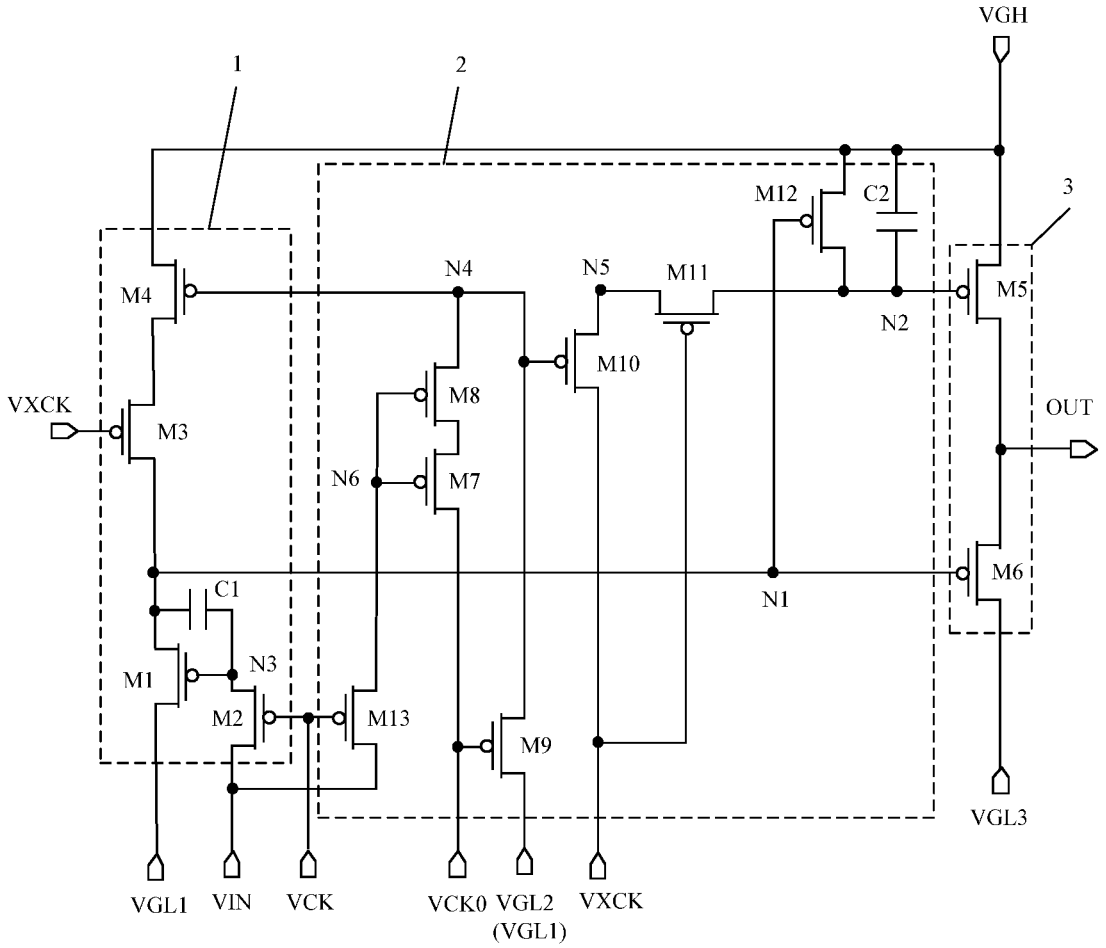
FIG. 5 is another circuit structure diagram of a shift register according to an embodiment of the present disclosure.
Figure 6:
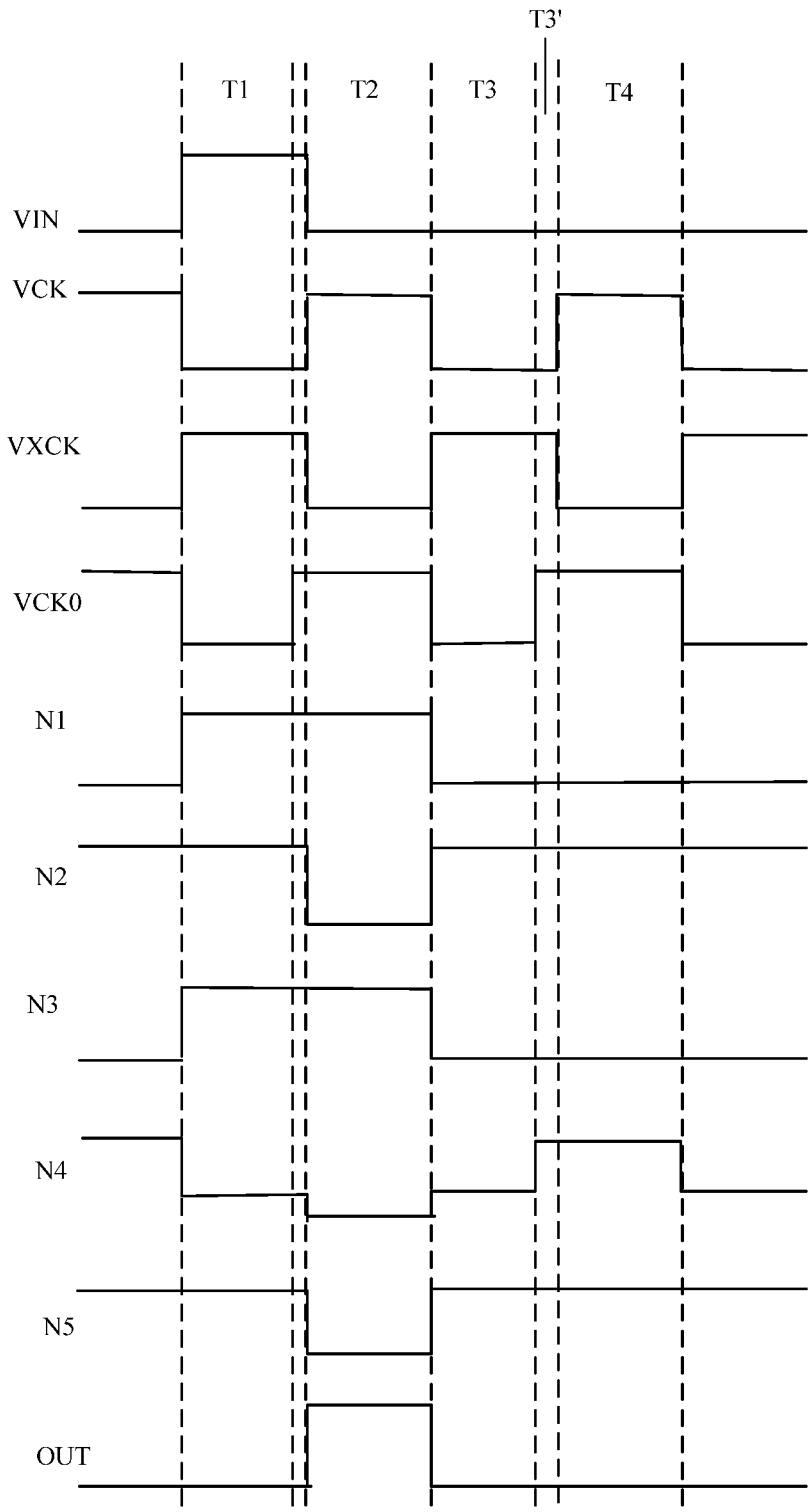
FIG. 6 is an operating sequence diagram of the shift register according to the embodiment of the present disclosure shown in FIG. 5.

According to an embodiment of the present disclosure, a shift register is provided as shown in FIGS. 3 to 6. FIG. 3 is a circuit structure diagram of the shift register according to the embodiment of the present disclosure, and FIG. 4 is an operating sequence diagram of the shift register according to the embodiment of the present disclosure shown in FIG. 3. FIG. 5 is another circuit structure diagram of a shift register according to an embodiment of the present disclosure, and FIG. 6 is an operating sequence diagram of the shift register according to the embodiment of the present disclosure shown in FIG. 5. The shift register includes a first node control module 1, a second node control module 2 and an output control module 3.

The first node control module 1 is electrically connected to an input signal terminal, a first low level signal terminal, a first clock signal terminal, a second clock signal terminal and a high level signal terminal, and is configured to control a level at a first node N1 based on an input signal, a first low level signal VGL1, a first clock signal VCK, a second clock signal VXCK and a high level signal VGH.

The second node control module 2 is electrically connected to a second low level signal terminal, the first clock signal terminal, the second clock signal terminal, a third clock signal terminal, the high level signal terminal and the first node N1, and is configured to control a level at a second node N2 based on a second low level signal VGL2, the first clock signal VCK, the second clock signal VXCK, a third clock signal VCK0, the high level signal VGH and the level at the first node N1.

The output control module 3 is electrically connected to the high level signal terminal, a third low level signal terminal, the first node N1 and the second node N2, and is configured to control an output terminal OUT to output the high level signal VGH or a third low level signal VGL3 based on the high level signal VGH, the third low level signal VGL3, the level at the first node N1 and the level at the second node N2.

The output control module 3 includes a transistor for outputting low level, and the transistor is a PMOS transistor.

The PMOS transistor has a control terminal electrically connected to the first node N1, a first terminal electrically connected to the third low level signal terminal and a second terminal electrically connected to the output terminal OUT. When the first low level signal VGL1 provides low level at the first node N1 and the high level signal VGH provides high level at the second node N2, the low level at the first node N1 controls the transistor for outputting low level in the output control module 3 in such a manner that the output terminal OUT outputs the third low level signal VGL3. The first low level signal VGL1, the third low level signal VGL3 and a threshold voltage Vth1 of the transistor for outputting low level in the output control module 3 satisfy a relation of VGL3>VGL1+|Vth1|, such that in a phase following the output terminal OUT outputting the high level signal VGH, the output terminal OUT completely outputs the third low level signal VGL3.

In an example, the third low level signal VGL3 is −7V, the threshold voltage Vth1 of the transistor for outputting low level in the output control module 3 is 2V, and the first low level signal VGL1 is −10V.

It should be noted that two signals named differently represent two different signals, unless they are specified to be the same one.

Figure 1:
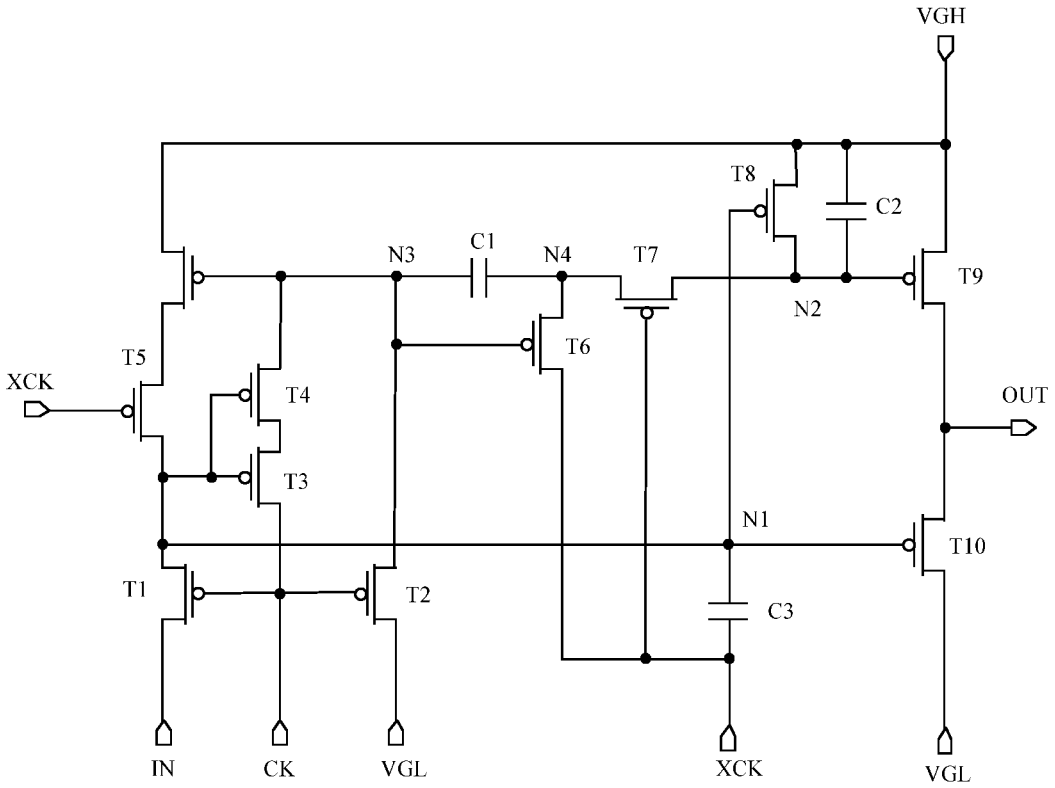
FIG. 1 (PRIOR ART)
FIG. 1 is a circuit structure diagram of a shift register provided in the related art.
Figure 2:
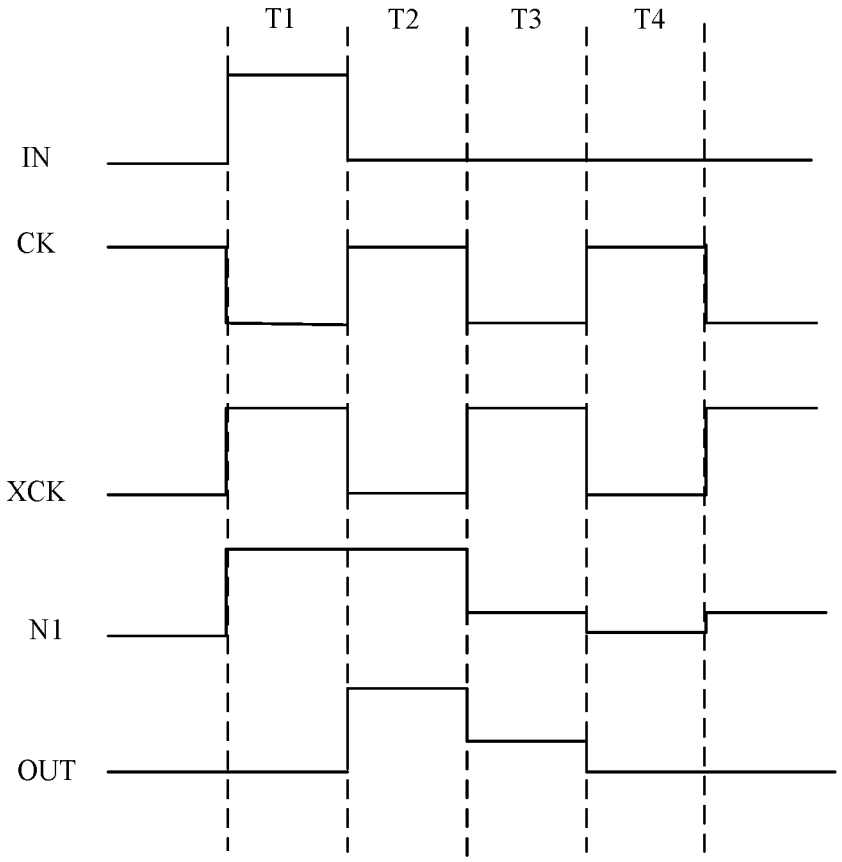
FIG. 2 (PRIOR ART)
FIG. 2 is an operating sequence diagram of a shift register provided in the related art.

As shown in FIGS. 1 and 2, according to the related art, a capacitor C3 connected to the node N1 is used to continuously provide a pull-down effect to the node N1 in a third phase T3 (i.e., a phase when low level is maintained), such that the output terminal OUT can effectively output low level. However, when the level at the output terminal OUT changes from high to low, the level at the node N1 is not low enough, such that there is falling step in a wave outputted in the third phase T3.

According to the embodiments of the present disclosure, the transistor for outputting the low level in the output control module 3 has a control terminal electrically connected to the first node N1, a first terminal electrically connected to the third low level signal terminal and a second terminal electrically connected to the output terminal OUT. When the first low level signal VGL1 provides low level at the first node N1 and the high level signal VGH provides high level at the second node N2, the low level at the first node N1 controls the transistor for outputting low level in the output control module 3 in such a manner that the output terminal OUT outputs the third low level signal VGL3. In a phase following the output terminal OUT outputting the high level signal VGH, when the transistor for outputting low level outputs the low level, a voltage of the control terminal of the transistor is provided by the first low level signal VGL1, and a voltage of the first terminal of the transistor is provided by the third low level signal VGL3. Since the voltage of the control terminal and the voltage of the first terminal satisfy a relation of VGL3−VGL1>|Vth1|, the voltage of the first terminal can be completely outputted to the output terminal OUT and thus the output terminal OUT can completely output the third low level signal VGL3, such that there is no falling step in the output wave and the shift register can output normally.

The first node control module 1 is configured to: in the first phase T1, provide high level at the first node N1, based on high level at the input signal VIN, low level at the first clock signal VCK, high level at the second clock signal VXCK and low level at the third clock signal VCK0; in the second phase T2, maintain the first node N1 at the high level in the first phase T1, based on low level at the input signal VIN, high level at the first clock signal VCK, low level at the second clock signal VXCK and high level at the third clock signal VCK0; in the third phase T3, provide low level at the first node N1, based on low level at the input signal VIN, low level at the first clock signal VCK, high level at the second clock signal VXCK and low level at the third clock signal VCK0; and in the fourth phase T4, maintain the first node N1 at the low level in the third phase T3, based on low level at the input signal VIN, high level at the first clock signal VCK, low level at the second clock signal VXCK and high level at the third clock signal VCK0.

The second node control module 2 is configured to: in the first phase T1, provide high level at the second node N2 based on the high level at the input signal VIN, the low level at the first clock signal VCK, the high level at the second clock signal VXCK, the low level at the third clock signal VCK0 and the high level at the first node N1; in the second phase T2, provide low level at the second node N2 based on the low level at the input signal VIN, the high level at the first clock signal VCK, the low level at the second clock signal VXCK, the high level at the third clock signal VCK0 and the high level at the first node N1; in the third phase T3, provide high level at the second node N2 based on the low level at the first node N1; and in the fourth phase T4, provide high level at the second node N2 based on the low level at the first node N1.

The output control module 3 is configured to: in the first phase T1, maintain the output terminal OUT at the low level outputted in the previous phase based on the high level at the first node N1 and the high level at the second node N2; in the second phase T2, control the output terminal OUT to output high level based on the high level at the first node N1 and the low level at the second node N2; in the third phase T3, control the output terminal OUT to output low level based on the low level at the first node N1 and the high level at the second node N2; and in the fourth phase T4, control the output terminal OUT to output low level based on the low level at the first node N1 and the high level at the second node N2.

To facilitate a better understanding and achieve beneficial effects of the above mentioned shift register, an embodiment of the present disclosure provides a driving method of the above mentioned shift register. Referring to FIGS. 3 to 6, the driving method includes:

in a first phase T1 when the input signal VIN is at high level, the first clock signal VCK is at low level, the second clock signal VXCK is at high level and the third clock signal VCK0 is at low level, providing, by the first node control module 1, high level at the first node N1, providing, by the second node control module 2, high level at the second node N2, and maintaining, by the output control module 3, the output terminal OUT at low level outputted in a previous phase;

in a second phase T2 when the input signal VIN is at low level, the first clock signal VCK is at high level, the second clock signal VXCK is at low level and the third clock signal VCK0 is at high level, maintaining, by the first node control module 1, the first node N1 at the high level in the first phase, providing, by the second node control module 2, low level at the second node N2, and controlling, by the output control module 3, the output terminal OUT to output the high level signal;

in a third phase T3 when the input signal VIN is at low level, the first clock signal VCK is at low level, the second clock signal VXCK is at high level and the third clock signal VCK0 is at low level, providing, by the first node control module 1, low level at the first node N1, providing, by the second node control module 2, high level at the second node N2, and controlling, by the output control module 3, the output terminal OUT to completely output the third low level signal VGL3; and in a fourth phase T4 when the input signal VIN is at low level, the first clock signal VCK is at high level, the second clock signal VXCK is at low level and the third clock signal VCK0 is at high level, maintaining, by the first node control module 1, the first node N1 at the low level in the third phase, providing, by the second node control module 2, high level at the second node N2, and maintaining, by the output control module 3, the output terminal OUT at the low level outputted in the third phase.

In the following description, the specific circuit structures of the first node control module 1, the second node control module 2 and the output control module 3 of the shift register will be explained with reference to FIGS. 3 to 6. It should be noted that the following description is also applicable to the shift register and its driving method according to the embodiments of the present disclosure.

In an embodiment of the present disclosure, as shown in FIGS. 3 and 5, the first node control module 1 includes a first transistor M1, a second transistor M2, a third transistor M3, a fourth transistor M4 and a first capacitor C1.

The first transistor M1 has a control terminal electrically connected to the third node N3, a first terminal electrically connected to the first low level signal terminal, and a second terminal electrically connected to the first node N1.

The second transistor M2 has a control terminal electrically connected to the first clock signal terminal, a first terminal electrically connected to the input signal VIN terminal, and a second terminal electrically connected to the third node N3.

The third transistor M3 has a control terminal electrically connected to the second clock signal terminal, a first terminal electrically connected to a second terminal of the fourth transistor M4, and a second terminal electrically connected to the first node N1.

The fourth transistor M4 has a control terminal electrically connected to a fourth node N4, a first terminal electrically connected to the high level signal terminal, and the second terminal electrically connected to the first terminal of the third transistor M3.

The first capacitor C1 has a first terminal electrically connected to the third node N3 and a second terminal electrically connected to the first node N1.

According to the embodiment of the present disclosure, each of the first transistor M1, the second transistor M2, the third transistor M3 and the fourth transistor M4 can be a PMOS transistor, which is switched on when its control terminal is at low level and switched off when the control terminal is at high level. Unless otherwise specified, the transistors mentioned in following the embodiments of the present disclosure are all PMOS transistors. In addition, when the first node control module 1 has the above structure, specific operating states of the first transistor M1, the second transistor M2, the third transistor M3, the fourth transistor M4 and the first capacitor C1 in respective operating phase of the shift register will be described in detail in the following descriptions.

In an embodiment, as shown in FIGS. 3 and 5, the output control module 3 includes a fifth transistor M5 and a sixth transistor M6.

The fifth transistor M5 has a control terminal electrically connected to the second node N2, a first terminal electrically connected to the high level signal terminal, and a second terminal electrically connected to the output terminal OUT.

The sixth transistor M6 has a control terminal electrically connected to the first node N1, a first terminal electrically connected to the third low level signal terminal and a second terminal electrically connected to the output terminal OUT. The sixth transistor M6 is the transistor for outputting the low level in the output control module 3. The first low level signal VGL1, the third low level signal VGL3 and the threshold voltage Vth1 of the sixth transistor M6 satisfy a relation of VGL3>VGL1+|Vth1|.

When the output control module 3 has the above structure, specific operating states of the fifth transistor M5 and the sixth transistor M6 in respective operating phase of the shift register will be described in detail in the following descriptions.

The above descriptions have mentioned three low level signals, i.e., the first low level signal VGL1, the second low level signal VGL2 and the third low level signal VGL3, and have just limited the relationship between the first low level signal VGL1 and the third low level signal VGL3. In an embodiment, the second low level signal VGL2 is the same as the third low level signal VGL3, and the first clock signal VCK is the same as the third clock signal VCK0. Alternatively, the second low level signal VGL2 is the same as the first low level signal VGL1. This can reduce the number of signal wirings provided for the shift register, thereby simplifying a structure of a display device and achieving a narrow border.

As for the two cases, the embodiments of the present disclosure provide two specific circuit structures of the second node control module 2, correspondingly.

In a first example, as shown in FIG. 3, the second low level signal VGL2 is the same as the third low level signal VGL3, and the first clock signal VCK is the same as the third clock signal VCK0.

In an embodiment, low level of the first clock signal VCK, low level of the second clock signal VXCK and low level of the third clock signal VCK0 are all equal to low level of the third low level signal VGL3; and high level of the first clock signal VCK, high level of the second clock signal VXCK and high level of the third clock signal VCK0 are all equal to high level of the high level signal VGH. This can reduce the number of signal wirings provided for the shift register, thereby simplifying a structure of a display device and achieving a narrow border.

In an embodiment, as shown in FIG. 3, the second node control module 2 includes a seventh transistor M7, an eighth transistor M8, a ninth transistor M9, a tenth transistor M1, an eleventh transistor M11, a twelfth transistor M12, a second capacitor C2 and a third capacitor C3.

A control terminal of the seventh transistor M7 and a control terminal of the eighth transistor M8 are electrically connected to the third node N3, a first terminal of the seventh transistor M7 is electrically connected to the third clock signal terminal, a second terminal of the seventh transistor M7 is electrically connected to a first terminal of the eighth transistor M8, and a second terminal of the eighth transistor M8 is electrically connected to the fourth node N4.

The ninth transistor M9 has a control terminal electrically connected to the third clock signal terminal, a first terminal electrically connected to the second low level signal terminal VGL2 and a second terminal electrically connected to the fourth node N4.

The tenth transistor M10 has a control terminal electrically connected to the fourth node N4, a first terminal electrically connected to the second clock signal terminal and a second terminal electrically connected to a fifth node N5.

The eleventh transistor M11 has a control terminal electrically connected to the second clock signal terminal, a first terminal electrically connected to the fifth node N5 and a second terminal electrically connected to the second node N2.

The twelfth transistor M12 has a control terminal electrically connected to the first node N1, a first terminal electrically connected to the high level signal terminal and a second terminal electrically connected to the second node N2.

The second capacitor C2 has a first terminal electrically connected to the high level signal terminal and a second terminal electrically connected to the second node N2.

The third capacitor C3 has a first terminal electrically connected to the fourth node N4 and a second terminal electrically connected to the fifth node N5.

The above connection manner of the seventh transistor M7 and the eighth transistor M8 can effectively reduce leakage current through these two transistors, which can facilitate maintaining the level stability of the fourth node N4.

When the second node control module 2 has the above structure, specific operating states of the seventh to the twelfth transistors M7-M12, the second capacitor C2 and the third capacitor C3 in respective operating phase of the shift register will be described in detail in the following descriptions.

In a second example, as show in FIG. 5, the second low level signal VGL2 is the same as the first low level signal VGL1.

In an embodiment, as shown in FIG. 5, the second node control module 2 includes a seventh transistor M7, an eighth transistor M8, a ninth transistor M9, a tenth transistor M10, an eleventh transistor M11, a twelfth transistor M12, a thirteenth transistor M13 and a second capacitor C2.

A control terminal of seventh transistor M7 and a control terminal of the eighth transistor M8 are electrically connected to a sixth node N6, a first terminal of seventh transistor M7 is electrically connected to the third clock signal terminal, a second terminal of seventh transistor M7 is electrically connected to a first terminal of the eighth transistor M8, and a second terminal of the eighth transistor M8 is electrically connected to the fourth node N4.

The ninth transistor M9 has a control terminal electrically connected to the third clock signal terminal, a first terminal electrically connected to the second low level signal terminal and a second terminal electrically connected to the fourth node N4.

The tenth transistor M10 has a control terminal electrically connected to the fourth node N4, a first terminal electrically connected to the second clock signal terminal and a second terminal electrically connected to a fifth node N5.

The eleventh transistor M11 has a control terminal electrically connected to the second clock signal terminal, a first terminal electrically connected to the fifth node N5 and a second terminal electrically connected to the second node N2.

The twelfth transistor M12 has a control terminal electrically connected to the first node N1, a first terminal electrically connected to the high level signal terminal and a second terminal electrically connected to the second node N2.

The thirteenth transistor M13 has a control terminal electrically connected to the first clock signal terminal, a first terminal electrically connected to the input signal terminal and a second terminal electrically connected to the sixth node N6.

The second capacitor C2 has a first terminal electrically connected to the high level signal terminal and a second terminal electrically connected to the second node N2.

Similarly, the connection manner of the seventh transistor M7 and the eighth transistor M8 can effectively reduce leakage current through these two transistors, which can facilitate maintaining the level stability of the fourth node N4. When the second node control module 2 has the above structure, specific operating states of the seventh to the thirteenth transistors M7-M13 and the second capacitor C2 in respective operating phase of the shift register will be described in detail in the following descriptions.

In an embodiment, low level of the first clock signal VCK is equal to low level of the third low level signal VGL3. This can reduce the number of signal wirings provided for the shift register, thereby simplifying a structure of a display device and achieving a narrow border.

As shown in FIG. 5, since the control terminal of the ninth transistor M9 is electrically connected to the third clock signal terminal, the first terminal of the ninth transistor M9 is electrically connected to the second low level signal terminal and the second terminal of the ninth transistor M9 is electrically connected to the fourth node N4, the ninth transistor M9 functions to transmit the second low level signal VGL2 when being switched on. If the low level of the third clock signal VCK0 at the control terminal of the ninth transistor M9 is higher, there would be a larger loss in the transmitted second low level signal VGL2. For example, when the low level of the third clock signal VCK0 is −7V and the second low level signal VGL2 is −10V, since the ninth transistor M9 is a PMOS transistor and it is needed to satisfy that Vsg is larger than the threshold voltage Vth2 (e.g., 2V) of the ninth transistor M9 during the transmission, the second low level signal VGL2 has a voltage of about −5V when arriving at the fourth node N4, which can result in that the shift register cannot operate normally.

Therefore, according to the embodiment of the present disclosure, low level of the first clock signal VCK is equal to low level of the third low level signal VGL3, and the low level VCK' of the first clock signal VCK, low level VCK0' of the third clock signal VCK0 and the threshold voltage Vth2 of the ninth transistor M9 satisfy a relation of $VCK' > VCK0' + |Vth2|$. In this way, when the ninth transistor M9 is switched on, its control terminal has a low voltage, such that the low level provided by the second low level signal VGL2 at its first terminal can easily arrive at the fourth node N4 through the ninth transistor M9. Therefore, the shift register can operate normally. In an embodiment, the low level of the first clock signal VCK and the low level of the third low level signal VGL3 are both −7V, and the low level of the third clock signal VCK0 is −10V.

As mentioned above, the first low level signal VGL1, the third low level signal VGL 3 and the threshold voltage Vth1 of the transistor for outputting low level in the output control module 3 satisfy a relation of $VGL3 > VGL1 + |Vth1|$. When the transistor for outputting low level in the output control module 3 and the ninth transistor M9 are manufactured by using the same process such that Vth1 and Vth2 are close and even equal, such arrangement can allow the low level of the third clock signal VCK0 and the low level of the first low level signal VGL1 to be equal, and further the both can be connected to one wiring. This can reduce the number of signal wirings provided for the shift register, thereby simplifying a structure of a display device while achieving a narrow border.

It is also possible to make the low level at the control terminal of the ninth transistor M9 to be lower, thereby better transmitting the second low level signal VGL2. For example, low level of the first clock signal VCK is equal to low level of the first low level signal VGL1, the low level VCK' of the first clock signal VCK, low level VCK0' of the third clock signal VCK0 and the threshold voltage Vth2 of the ninth transistor satisfy a relation of VCK'>VCK0'+|Vth2|.

It should be noted that the high level of the first clock signal VCK and the high level of the third clock signal VCK0 are not limited in the above descriptions and can be selected based on actual requirements.

Further, the low level of the first clock signal VCK and the low level of the second clock signal VXCK are both equal to low level of the third low level signal VGL3. The low level of the third clock signal VCK0 is equal to the low level of the first low level signal VGL1. The high level of the first clock signal VCK, high level of the second clock signal VXCK and high level of the third clock signal VCK0 are all equal to high level of the high level signal VGH. This can reduce the number of signal wirings provided for the shift register, thereby simplifying a structure of a display device while achieving a narrow border.

In an embodiment, a time at which the third clock signal VCK0 changes from the low level to the high level is earlier than a time at which the first clock signal VCK changes from the low level to the high level. Between the third phase T3 and the fourth phase T4, the third clock signal VCK0 firstly changes to the high level and then the first clock signal VCK changes to the high level. That is, there is a transition phase T3' between the third phase T3 and the fourth phase T4, in which the third clock signal VCK0 is at the high level and the first clock signal VCK is at the low level. During the transition phase T3', the high level is provided at the fourth node N4, so as to avoid that the fourth transistor M4 controlled by the fourth node N4 is switched on in the fourth phase T4, which would otherwise provide the high level signal VGH provided at the high level signal terminal to the first node N1.

In the following, by taking a shift register having circuit structure shown in FIG. 3 or 5 as an example, specific operating states of respective transistors and capacitors will be explained in detail by referring to operating sequence diagrams as shown in FIG. 4 or 6.

In a first example, the shift register has a circuit structure as shown in FIG. 3. An operating sequence of the shift register, as shown in FIG. 4, includes operating process as follows.

In a first phase T1, the input signal VIN provided by the input signal terminal is at the high level, the first clock signal VCK provided by the first clock signal terminal is at the low level, the second clock signal VXCK provided by the second clock signal terminal is at the high level, and the third clock signal VCK0 provided by the third clock signal terminal is at the low level. The second transistor M2 under control of the first clock signal VCK is switched on. The input signal VIN arrives at the third node N3, which is at the high level. The seventh transistor M7 and the eighth transistor M8 are switched off. The first transistor M1 is switched off. The first node N1 is placed at the high level by means of coupling effect of the first capacitor C1. The sixth transistor M6 is switched off. The twelfth transistor M12 is switched off. The ninth transistor M9 under control of the third clock signal VCK0 is switched on. The second low level signal VGL2 arrives at the fourth node N4, which is at the low level. The fourth transistor M4 is switched on. The tenth transistor M10 is switched on. The second clock signal VXCK arrives at the fifth node N5, which is at the high level. The third transistor M3 and the eleventh transistor M11 under control of the second clock signal VXCK are switched off. The second node N2 is placed at the high level by means of coupling effect of the second capacitor C2. The fifth transistor M5 is switched off. The output terminal OUT continuously outputs the low level in the previous phase.

In a second phase T2, the input signal VIN is at the low level, the first clock signal VCK is at the high level, the second clock signal VXCK is at the low level, and the third clock signal VCK0 is at the high level. The second transistor M2 under control of the first clock signal VCK is switched off. The third node N3 is maintained at the high level by the first capacitor C1. The seventh transistor M7 and the eighth transistor M8 are switched off. The first transistor M1 is switched off. The ninth transistor M9 under control of the third clock signal VCK0 is switched off. The fourth node N4 is maintained at the low level by the third capacitor C3. The fourth transistor M4 is switched on. The tenth transistor M10 is switched on. The second clock signal VXCK arrives at the fifth node N5, which is at the low level. The level at the fourth node N4 is made lower by coupling effect of the third capacitor C3. The third transistor M3 and the eleventh transistor M11 under control of the second clock signal VXCK are switched on. The high level signal VGH arrives at the first node N1 through the third transistor M3 and the fourth transistor M4. The first node N1 is at the high level. The sixth transistor M6 is switched off. The twelfth transistor M12 is switched off. The level at the fifth node N5 arrives at the second node N2 through the eleventh transistor M11, such that the second node N2 is at the low level. The fifth transistor M5 is switched on. The output terminal OUT outputs the high level of the high level signal VGH.

In a third phase T3, the input signal VIN is at the low level, the first clock signal VCK is at the low level, the second clock signal VXCK is at the high level, and the third clock signal VCK0 is at the low level. The second transistor M2 under control of the first clock signal VCK is switched on. The input signal VIN arrives at the third node N3, which is at the low level. The seventh transistor M7 and the eighth transistor M8 are switched on. The first transistor M1 is switched on. The first low level signal VGL1 arrives at the first node N1, which is then at the low level. The sixth transistor M6 is switched on. The twelfth transistor M12 is switched on. The output terminal OUT completely outputs the third low level signal VGL3. The high level signal VGH arrives at the second node N2, which is then at the high level. The third clock signal VCK0 arrives at the fourth node N4. The ninth transistor M9 under control of the third clock signal VCK0 is switched on. The second low level signal VGL2 arrives at the fourth node N4, which is then at the low level. The fourth transistor M4 is switched on. The tenth transistor M10 is switched on. The second clock signal VXCK arrives at the fifth node N5, which is then at the high level. The third transistor M3 and the eleventh transistor M11 under control of the second clock signal VXCK are switched off.

In a fourth phase T4, the input signal VIN is at the low level, the first clock signal VCK is at the high level, the second clock signal VXCK is at the low level, and the third clock signal VCK0 is at the high level. The second transistor M2 under control of the first clock signal VCK is switched off. The third node N3 is maintained at the low level by the first capacitor C1. The seventh transistor M7 and the eighth transistor M8 are switched on. The first transistor M1 is switched on. The first low level signal VGL1 arrives at the first node N1, which is then at the low level. The sixth transistor M6 is switched on. The twelfth transistor M12 is switched on. The output terminal OUT completely outputs the third low level signal VGL3. The high level signal VGH arrives at the second node N2, which is then at the high level. The fifth transistor M5 is switched off. The third clock signal VCK0 arrives at the fourth node N4 through the seventh transistor M7 and the eighth transistor M8. The ninth transistor M9 under control of the third clock signal VCK0 is switched off. The fourth node N4 is at the high level. The fourth transistor M4 is switched off. The tenth transistor M10 is switched off. The third transistor M3 and the eleventh transistor M11 under control of the second clock signal VXCK are switched on. The level at the second node N2 arrives at the fifth node N5 through the eleventh transistor M11. The fifth node N5 is then at the high level.

Figure 7:
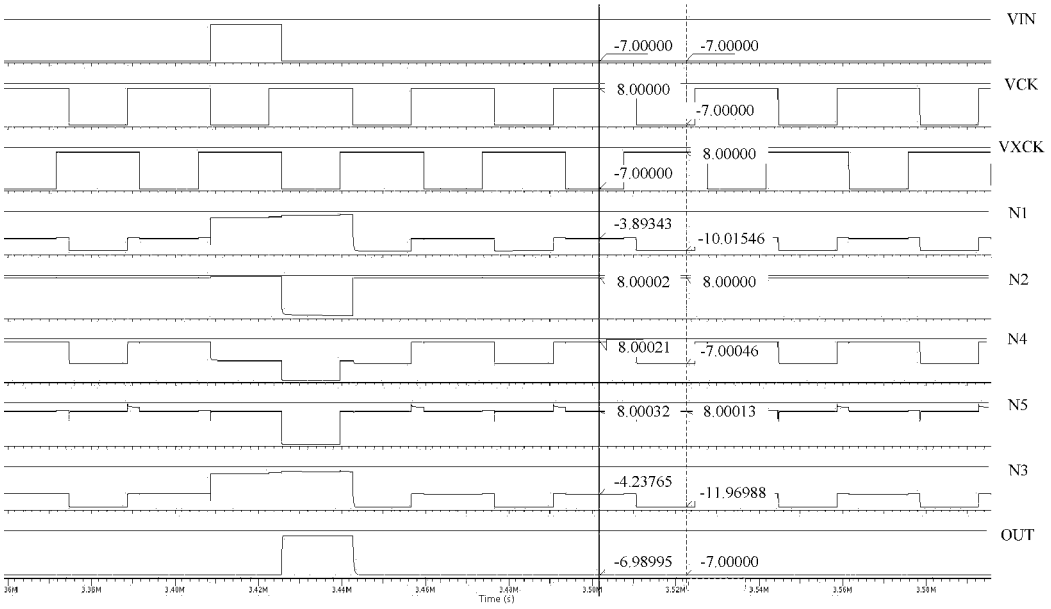
FIG. 7 is a signal simulation diagram of the shift register according to the embodiment of the present disclosure shown in FIG. 3.

FIG. 7 is a signal simulation diagram of the shift register according to the embodiment of the present disclosure shown in FIG. 3. There is no falling step in an output wave of the shift register having the circuit structure as shown in FIG. 3. The simulation process involves following parameters: high level of the input signal of 8.00000V, low level of the input signal of −7.00000V, high level of the first clock signal VCK of 8.00000V, low level of the first clock signal VCK of −7.00000V, high level of the second clock signal VXCK of 8.00000V, low level of the second clock signal VXCK of −7.00000V, low level of the first low level signal VGL1 of −10V, low level of the second low level signal VGL2 of −7V, and low level of the third low level signal VGL3 of −7V.

In a second example, the shift register has a circuit structure as shown in FIG. 5. An operating sequence of the shift register, as shown in FIG. 6, includes operating process as follows.

In a first phase T1, the input signal VIN provided by the input signal terminal is at the high level, the first clock signal VCK provided by the first clock signal terminal is at the low level, the second clock signal VXCK provided by the second clock signal terminal is at the high level, and the third clock signal VCK0 provided by the third clock signal terminal is at the low level. The second transistor M2 under control of the first clock signal VCK is switched on. The thirteenth transistor M13 is switched on. The input signal VIN arrives at the third node N3 through the second transistor M2. The third node N3 is at the high level. The first transistor M1 is switched off. The first node N1 is placed at the high level by means of coupling effect of the first capacitor C1. The sixth transistor M6 is switched off. The twelfth transistor M12 is switched off. The input signal VIN arrives at the sixth node N6 through the thirteenth transistor M13. The sixth node N6 is at the high level. The seventh transistor M7 and the eighth transistor M8 are switched off. The ninth transistor M9 under control of the third clock signal VCK0 is switched on. The second low level signal VGL2 arrives at the fourth node N4, which is then at the low level. The fourth transistor M4 is switched on. The tenth transistor M10 is switched on. The second clock signal VXCK arrives at the fifth node N5, which is then at the high level. The third transistor M3 and the eleventh transistor M11 under control of the second clock signal VXCK are switched off. The second node N2 is placed at the high level by means of coupling effect of the second capacitor C2. The fifth transistor M5 is switched off. The output terminal OUT continuously outputs the low level in the previous phase.

In a second phase T2, the input signal VIN is at the low level, the first clock signal VCK is at the high level, the second clock signal VXCK is at the low level, and the third clock signal VCK0 is at the high level. The second transistor M2 under control of the first clock signal VCK is switched off. The thirteenth transistor M13 is switched off. The third node N3 is maintained at the high level by the first capacitor C1. The first transistor M1 is switched off. The ninth transistor M9 under control of the third clock signal VCK0 is switched off. The fourth node N4 is maintained at the low level. The fourth transistor M4 is switched on. The tenth transistor M10 is switched on. The second clock signal VXCK arrives at the fifth node N5, which is at the low level. The level at the fourth node N4 is made lower by parasitic capacitance of the tenth transistor M10. The third transistor M3 and the eleventh transistor M11 under control of the second clock signal VXCK are switched on. The high level signal VGH arrives at the first node N1 through the third transistor M3 and the fourth transistor M4. The first node N1 is at the high level. The sixth transistor M6 is switched off. The twelfth transistor M12 is switched off. The level at the fifth node N5 arrives at the second node N2 through the eleventh transistor M11, such that the second node N2 is at the low level. The fifth transistor M5 is switched on. The output terminal OUT outputs the high level of the high level signal VGH.

In a third phase T3, the input signal VIN is at the low level, the first clock signal VCK is at the low level, the second clock signal VXCK is at the high level, and the third clock signal VCK0 is at the low level. The second transistor M2 under control of the first clock signal VCK is switched on. The thirteenth transistor M13 is switched on. The input signal VIN arrives at the third node N3 through the second transistor M2. The third node N3 is at the low level. The first transistor M1 is switched on. The first low level signal VGL1 arrives at the first node N1, which is then at the low level. The sixth transistor M6 is switched on. The twelfth transistor M12 is switched on. The output terminal OUT completely outputs the third low level signal VGL3. The high level signal VGH arrives at the second node N2, which is then at the high level. The input signal VIN arrives at the sixth node N6 through the thirteenth transistor M13. The sixth node N6 is at the low level. The seventh transistor M7 and the eighth transistor M8 are switched on. The third clock signal VCK0 arrives at the fourth node N4. The ninth transistor M9 under control of the third clock signal VCK0 is switched on. The second low level signal VGL2 arrives at the fourth node N4, which is then at the low level. The fourth transistor M4 is switched on. The tenth transistor M10 is switched on. The second clock signal VXCK arrives at the fifth node N5, which is then at the high level. The third transistor M3 and the eleventh transistor M11 under control of the second clock signal VXCK are switched off.

In a transition phase T3' (caused by the fact that a time at which the third clock signal VCK0 changes from the low level to the high level is earlier than a time at which the first clock signal VCK changes from the low level to the high level), the input signal VIN is at the low level, the first clock signal VCK is at the low level, the second clock signal VXCK is at the high level, and the third clock signal VCK0 is at the high level. The second transistor M2 under control of the first clock signal VCK is switched on. The thirteenth transistor M13 is switched on. The input signal VIN arrives at the third node N3 through the second transistor M2. The third node N3 is at the low level. The first transistor M1 is switched on. The first low level signal VGL1 arrives at the first node N1, which is then at the low level. The sixth transistor M6 is switched on. The twelfth transistor M12 is switched on. The output terminal OUT completely outputs the third low level signal VGL3. The high level signal VGH arrives at the second node N2, which is then at the high level. The input signal VIN arrives at the sixth node N6 through the thirteenth transistor M13. The sixth node N6 is at the low level. The seventh transistor M7 and the eighth transistor M8 are switched on. The third clock signal VCK0 arrives at the fourth node N4. The ninth transistor M9 under control of the third clock signal VCK0 is switched off. The fourth node N4 is at the high level. The fourth transistor M4 is switched off. The tenth transistor M10 is switched off. The fifth node N5 is maintained at the high level. The third transistor M3 and the eleventh transistor M11 under control of the second clock signal VXCK are switched off.

In a fourth phase T4, the input signal VIN is at the low level, the first clock signal VCK is at the high level, the second clock signal VXCK is at the low level, and the third clock signal VCK0 is at the high level. The second transistor M2 under control of the first clock signal VCK is switched off. The thirteenth transistor M13 is switched off. The third node N3 is maintained at the low level by the first capacitor C1. The seventh transistor M7 and the eighth transistor M8 are switched on. The first transistor M1 is switched on. The first low level signal VGL1 arrives at the first node N1, which is then at the low level. The sixth transistor M6 is switched on. The twelfth transistor M12 is switched on. The output terminal OUT completely outputs the third low level signal VGL3. The high level signal VGH arrives at the second node N2, which is then at the high level. The fifth transistor M5 is switched off. The sixth node N6 is maintained at the low level. The third clock signal VCK0 arrives at the fourth node N4. The ninth transistor M9 under control of the third clock signal VCK0 is switched off. The fourth node N4 is at the high level. The fourth transistor M4 is switched off. The tenth transistor M10 is switched off. The third transistor M3 and the eleventh transistor M11 under control of the second clock signal VXCK are switched on. The level at the second node N2 arrives at the fifth node N5 through the eleventh transistor M11. The fifth node N5 is then at the high level.

The fourth transistor M4 is switched off and the third transistor M3 is switched off in the transition phase T3', so as to prevent the high level signal VGH from arriving at the first node N1 in the fourth phase T4, thereby maintaining the low level at the first node N1 and further allowing the output terminal OUT to continuously output low level.

Figure 8:
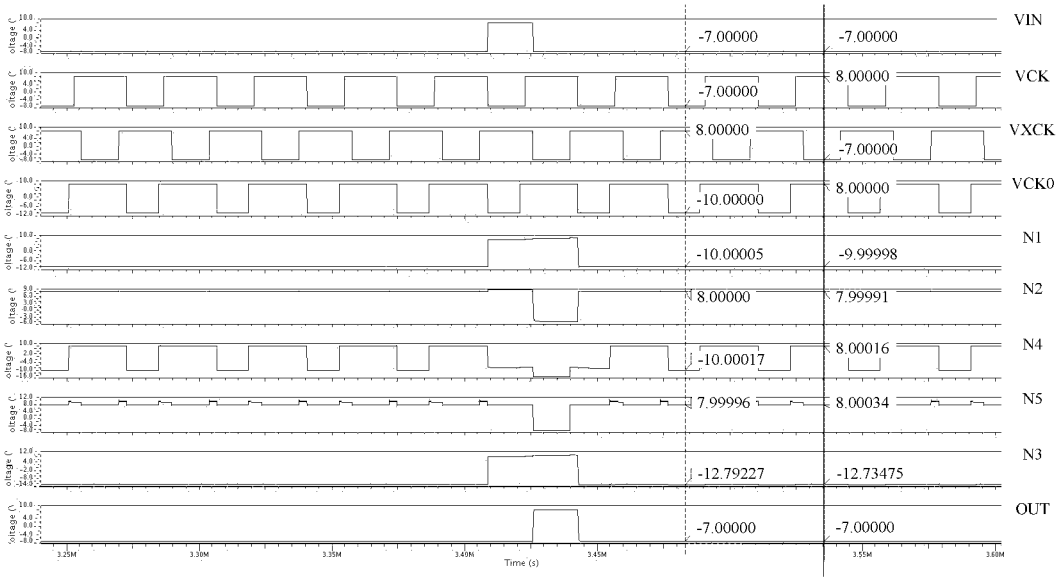
FIG. 8 is a signal simulation diagram of the shift register according to the embodiment of the present disclosure shown in FIG. 5.

FIG. 8 is a signal simulation diagram of the shift register according to the embodiment of the present disclosure shown in FIG. 5. There is no falling step in an output wave of the shift register having the circuit structure as shown in FIG. 5. The simulation process involves following parameters: high level of the input signal of 8.00000V, low level of the input signal of −7.00000V, high level of the first clock signal VCK of 8.00000V, low level of the first clock signal VCK of −7.00000V, high level of the second clock signal VXCK of 8.00000V, low level of the second clock signal VXCK of −7.00000V, high level of the third clock signal VCK0 of 8.00000V, low level of the third clock signal VCK0 of −10.00000V, low level of the first low level signal VGL1 of −10V, low level of the second low level signal VGL2 of −10V, and low level of the third low level signal VGL3 of −7V.

Figure 9:
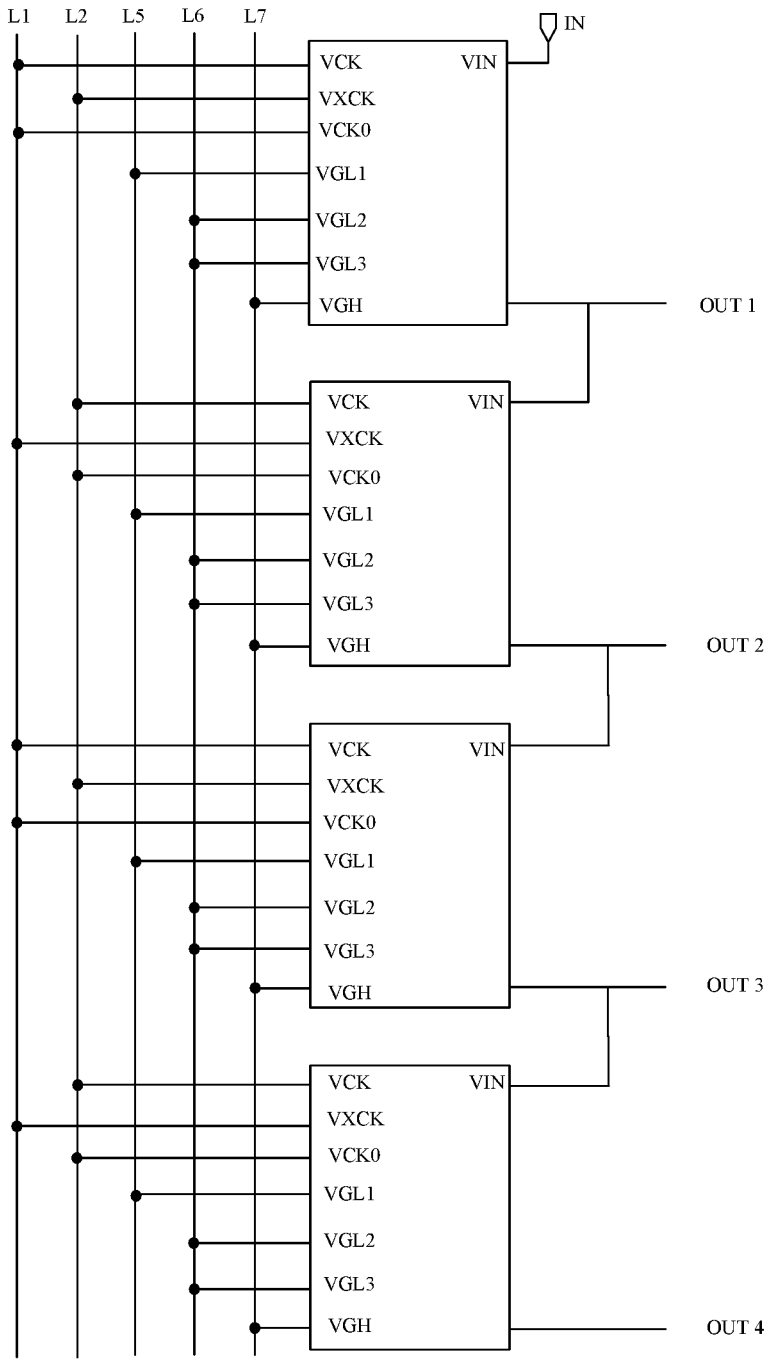
FIG. 9 is a schematic diagram of an emission driving circuit according to an embodiment of the present disclosure.
Figure 10:
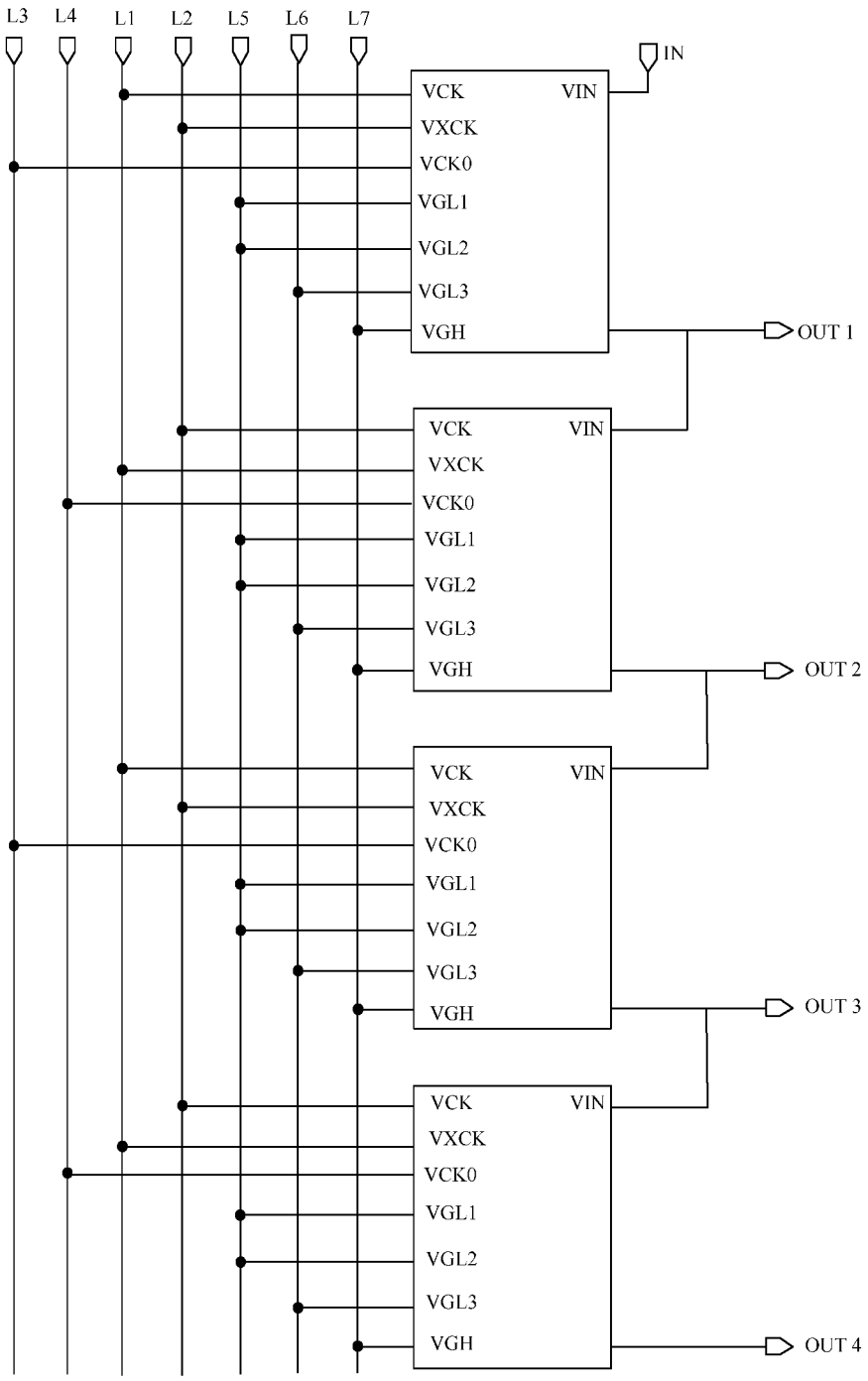
FIG. 10 is another schematic diagram of an emission driving circuit according to an embodiment of the present disclosure.

The embodiments of the present disclosure further provide an emission driving circuit, as shown in FIGS. 9 and 10. FIG. 9 is a schematic diagram of an emission driving circuit according to an embodiment of the present disclosure. FIG. 10 is another schematic diagram of an emission driving circuit according to an embodiment of the present disclosure. The emission driving circuit includes a first signal line L1, a second signal line L2, and a plurality of cascaded shift registers. Each stage of shift register can be any shift register mentioned above.

Shift register at each odd-numbered stage has a first clock signal terminal electrically connected to the first signal line L1, and a second clock signal terminal electrically connected to the second signal line L2.

Shift register at each even-numbered stage has a first clock signal terminal electrically connected to the second signal line L2, and a second clock signal terminal electrically connected to the first signal line L1.

It should be noted that specific circuit structures and operating sequences of respective shift registers included in the emission driving circuit as shown in FIG. 9 are illustrated in FIGS. 3 and 4, and specific circuit structures and operating sequences of respective shift registers included in the emission driving circuit as shown in FIG. 10 are illustrated in FIGS. 5 and 6.

Further, as illustrated in FIGS. 9 and 10, a $n^{th}$ stage of shift register of the cascaded shift registers has an input signal terminal electrically connected to an output terminal OUT (n−1) of a $(n-1)^{th}$ stage of shift register, where n is 2, 3, 4, . . . , or N, and N is a number of shift registers in the emission driving circuit. The input signal terminal of the first stage of shift register can be either individually connected to the input signal line, or connected to the output terminal OUT of the $N^{th}$ stage of shift register, which is not limited in the embodiments of the present disclosure.

When the specific circuit structures and operating sequences of the respective shift registers included in the emission driving circuit are illustrated in FIGS. 3 and 4, as shown in FIG. 9, the emission driving circuit according to the embodiments of the present disclosure further includes a fifth signal line L5, a sixth signal line L6 and a seventh signal line L7. Each stage of shift register has a first low level signal terminal electrically connected to the fifth signal line L5, a second low level signal terminal and a third low level signal terminal both electrically connected to the sixth signal line L6, and a high level signal terminal electrically connected to the seventh signal line L7. Since the third clock signal VCK0 is the same as the first clock signal VCK at this moment, each stage of shift register has a third clock signal terminal, it is only needed to connect the third clock signal terminal and the first clock signal terminal to the same signal line, without arranging an additional signal line.

In an embodiment, when the specific circuit structures and operating sequences of the respective shift registers included in the emission driving circuit are illustrated in FIGS. 5 and 6, the low level of the first clock signal VCK is equal to the low level of the third low level signal VGL3, and the low level VCK' of the first clock signal VCK, the low level VCK0' of the third clock signal VCK0 and the threshold voltage Vth2 of the ninth transistor M9 satisfy a relation of VCK'>VCK0'+|Vth2|. As shown in FIG. 8, the emission driving circuit according to the embodiment of the present disclosure further includes a third signal line L3 and a fourth signal line L4.

Shift register at each odd-numbered stage has a third clock signal terminal electrically connected to the third signal line L3.

Shift register at each even-numbered stage has a third clock signal terminal electrically connected to the fourth signal line L4.

As shown in FIG. 10, the emission driving circuit according to the embodiment of the present disclosure further includes a fifth signal line L5, a sixth signal line L6 and a seventh signal line L7. Each stage of shift register has a first low level signal terminal and a second low level signal terminal both electrically connected to the fifth signal line L5, a third low level signal terminal electrically connected to the sixth signal line L6, and a high level signal terminal electrically connected to the seventh signal line L7.

Figure 11:
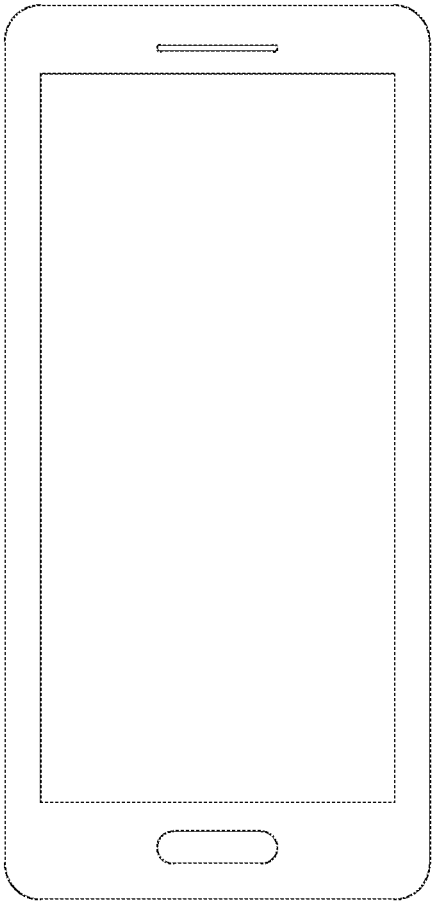
FIG. 11 is a top view of a display device according to an embodiment of the present disclosure.

In addition, the embodiments of the present disclosure further provide a display device as shown in FIG. 11. FIG. 11 is a schematic view of a display device according to an embodiment of the present disclosure. The display device includes the emission driving circuit as mentioned above. The display device according to the embodiments of the present disclosure can be any product or component having display function such as a smart phone, a wearable smart watch, intelligent glasses, a Tablet PC, a TV, a monitor, a laptop, a digital photo frame, a navigator, a car monitor, an e-book, and the like. The display panel and the display device provided in the embodiments of the present disclosure can be either flexible or non-flexible, which is not limited herein.

In an embodiment, the display device can be an organic light emitting display device including an organic light emitting display panel. The organic light emitting display panel includes a plurality of pixel circuits and a plurality of organic light-emitting diodes disposed on the display panel. Each organic light emitting diode has an anode electrically connected to a corresponding pixel circuit. The plurality of light emitting diodes includes a light emitting diode for emitting red light, a light emitting diode for emitting green light, and a light emitting diode for emitting blue light. In addition, the organic light emitting display panel further includes an encapsulation layer covering the plurality of organic light emitting diodes.

The embodiments of the present disclosure provide a shift register, a driving method of the shift register, an emission driving circuit, and a display device. The shift register includes a first node control module, a second node control module, and an output control module. The transistor for outputting the low level in the output control module has a control terminal electrically connected to the first node, a first terminal electrically connected to the third low level signal terminal and a second terminal electrically connected to the output terminal. When the first low level signal VGL1 provides the low level at the first node and the high level signal provides the high level at the second node, the low level at the first node controls the transistor for outputting the low level in the output control module in such a manner that the output terminal outputs the third low level signal VGL3. In a phase following the output terminal outputting the high level signal VGH, when the transistor for outputting the low level outputs low level, a voltage of the control terminal of the transistor is provided by the first low level signal VGL1, and a voltage of the first terminal of the transistor is provided by the third low level signal VGL3. Since the voltage of the control terminal and the voltage of the first terminal satisfy a relation of $VGL3-VGL1>|Vth1|$, the voltage of the first terminal can be completely outputted to the output terminal and thus the output terminal can completely output the third low level signal VGL3, such that there is no falling step in the output wave and the shift register can output normally.

Finally, it should be noted that, the above-described embodiments are merely for illustrating the present disclosure but not intended to provide any limitation. Although the present disclosure has been described in detail with reference to the above-described embodiments, it should be understood by those skilled in the art that, it is still possible to modify the technical solutions described in the above embodiments or to equivalently replace some or all of the technical features therein, but these modifications or replacements do not cause the essence of corresponding technical solutions to depart from the scope of the present disclosure.

What is claimed is:

1. An emission driving circuit, comprising a shift register, wherein the shift register comprises:

a first node control module electrically connected to an input signal terminal, a first low level signal terminal, a first clock signal terminal, a second clock signal terminal and a high level signal terminal, and configured to control a level at a first node based on an input signal, a first low level signal, a first clock signal, a second clock signal and a high level signal;

a second node control module electrically connected to a second low level signal terminal, the first clock signal terminal, the second clock signal terminal, a third clock signal terminal, the high level signal terminal and the first node, and configured to control a level at a second node based on a second low level signal, the first clock signal, the second clock signal, a third clock signal, the high level signal and the level at the first node; and an output control module electrically connected to the high level signal terminal, a third low level signal terminal, the first node and the second node, and configured to control an output terminal to output the high level signal or a third low level signal based on the high level signal, the third low level signal, the level at the first node and the level at the second node, wherein the output control module comprises a transistor for outputting a low level, and the transistor is a PMOS transistor having a control terminal electrically connected to the first node, a first terminal electrically connected to the third low level signal terminal and a second terminal electrically connected to the output terminal;

wherein when the first low level signal provides a low level at the first node and the high level signal provides a high level at the second node, the low level at the first node controls the transistor to output a low level in the output control module such that the output terminal outputs the third low level signal; and wherein the first low level signal, the third low level signal and a threshold voltage of the transistor for outputting low level in the output control module satisfy a relation that the third low level signal is greater than a sum of the first low level signal and an absolute value of the threshold voltage, such that in a phase following the output terminal outputting the high level signal, the output terminal completely outputs the third low level signal.

2. The emission driving circuit according to claim 1, wherein the second low level signal is equal to the third low level signal, and the first clock signal is equal to the third clock signal.

3. The emission driving circuit according to claim 2, wherein a low level of the first clock signal, a low level of the second clock signal and a low level of the third clock signal are all equal to a low level of the third low level signal, and a high level of the first clock signal, a high level of the second clock signal and a high level of the third clock signal are all equal to a high level of the high level signal.

4. The emission driving circuit according to claim 2, wherein the first node control module comprises a first transistor, a second transistor, a third transistor, a fourth transistor and a first capacitor, wherein the first transistor has a control terminal electrically connected to a third node, a first terminal electrically connected to the first low level signal terminal, and a second terminal electrically connected to the first node, wherein the second transistor has a control terminal electrically connected to the first clock signal terminal, a first terminal electrically connected to the input signal terminal, and a second terminal electrically connected to the third node, wherein the third transistor has a control terminal electrically connected to the second clock signal terminal, a first terminal electrically connected to a second terminal of the fourth transistor, and a second terminal electrically connected to the first node, wherein the fourth transistor has a control terminal electrically connected to a fourth node, a first terminal electrically connected to the high level signal terminal, and the second terminal electrically connected to the first terminal of the third transistor, and wherein the first capacitor has a first terminal electrically connected to the third node and a second terminal electrically connected to the first node.

5. The emission driving circuit according to claim 2, wherein the output control module comprises a fifth transistor and a sixth transistor, wherein the fifth transistor has a control terminal electrically connected to the second node, a first terminal electrically connected to the high level signal terminal, and a second terminal electrically connected to the output terminal, and wherein the sixth transistor has a control terminal electrically connected to the first node, a first terminal electrically connected to the third low level signal terminal and a second terminal electrically connected to the output terminal.

6. The emission driving circuit according to claim 2, wherein the second node control module comprises a seventh transistor, an eighth transistor, a ninth transistor, a tenth transistor, an eleventh transistor, a twelfth transistor, a second capacitor and a third capacitor, wherein a control terminal of the seventh transistor and a control terminal of the eighth transistor are electrically connected to a third node, a first terminal of the seventh transistor is electrically connected to the third clock signal terminal, a second terminal of the seventh transistor is electrically connected to a first terminal of the eighth transistor, and a second terminal of the eighth transistor is electrically connected to a fourth node, wherein the ninth transistor has a control terminal electrically connected to the third clock signal terminal, a first terminal electrically connected to the second low level signal terminal and a second terminal electrically connected to the fourth node, wherein the tenth transistor has a control terminal electrically connected to the fourth node, a first terminal electrically connected to the second clock signal terminal and a second terminal electrically connected to a fifth node, wherein the eleventh transistor has a control terminal electrically connected to the second clock signal terminal, a first terminal electrically connected to the fifth node and a second terminal electrically connected to the second node, wherein the twelfth transistor has a control terminal electrically connected to the first node, a first terminal electrically connected to the high level signal terminal and a second terminal electrically connected to the second node, wherein the second capacitor has a first terminal electrically connected to the high level signal terminal and a second terminal electrically connected to the second node, and wherein the third capacitor has a first terminal electrically connected to the fourth node and a second terminal electrically connected to the fifth node.

7. The emission driving circuit according to claim 1, wherein the second low level signal is equal to the first low level signal.

8. The emission driving circuit according to claim 7, wherein the second node control module comprises a seventh transistor, an eighth transistor, a ninth transistor, a tenth transistor, an eleventh transistor, a twelfth transistor, a thirteenth transistor and a second capacitor, wherein a control terminal of the seventh transistor and a control terminal of the eighth transistor are electrically connected to a sixth node, a first terminal of the seventh transistor is electrically connected to the third clock signal terminal, a second terminal of the seventh transistor is electrically connected to a first terminal of the eighth transistor, and a second terminal of the eighth transistor is electrically connected to a fourth node, wherein the ninth transistor has a control terminal electrically connected to the third clock signal terminal, a first terminal electrically connected to the second low level signal terminal and a second terminal electrically connected to the fourth node, wherein the tenth transistor has a control terminal electrically connected to the fourth node, a first terminal electrically connected to the second clock signal terminal and a second terminal electrically connected to a fifth node, wherein the eleventh transistor has a control terminal electrically connected to the second clock signal terminal, a first terminal electrically connected to the fifth node and a second terminal electrically connected to the second node, wherein the twelfth transistor has a control terminal electrically connected to the first node, a first terminal electrically connected to the high level signal terminal and a second terminal electrically connected to the second node, wherein the thirteenth transistor has a control terminal electrically connected to the first clock signal terminal, a first terminal electrically connected to the input signal terminal and a second terminal electrically connected to the sixth node, and wherein the second capacitor has a first terminal electrically connected to the high level signal terminal and a second terminal electrically connected to the second node.

9. The emission driving circuit according to claim 8, wherein a low level of the first clock signal is equal to a low level of the third low level signal, and the low level of the first clock signal, a low level of the third clock signal and a threshold voltage of the ninth transistor satisfy a relationship that the low level of the first clock signal is greater than a sum of the low level of the third clock signal and an absolute value of the threshold voltage of the ninth transistor.

10. The emission driving circuit according to claim 9, wherein the low level of the first clock signal and a low level of the second clock signal are both equal to the low level of the third low level signal, the low level of the third clock signal is equal to a low level of the first low level signal, and a high level of the first clock signal, a high level of the second clock signal and a high level of the third clock signal are all equal to a high level of the high level signal.

11. The emission driving circuit according to claim 10, wherein a time at which the third clock signal changes from the low level to the high level is earlier than a time at which the first clock signal changes from the low level to the high level.

12. The emission driving circuit according to claim 1, comprising a first signal line, a second signal line, and a plurality of cascaded shift registers, wherein the first clock signal terminal of a shift register at each odd-numbered stage of the plurality of cascaded shift registers and the second clock signal terminal of a shift register at each even-numbered stage of the plurality of cascaded shift registers are both electrically connected to the first signal line, and wherein the second clock signal terminal of a shift register at each odd-numbered stage of the plurality of cascaded shift registers and the first clock signal terminal of a shift register at each even-numbered stage of the plurality of cascaded shift registers are both electrically connected to the second signal line.

13. The emission driving circuit according to claim 12, wherein the second low level signal is the same as the first low level signal, wherein the second node control module comprises a seventh transistor, an eighth transistor, a ninth transistor, a tenth transistor, an eleventh transistor, a twelfth transistor, a thirteenth transistor and a second capacitor, a control terminal of the seventh transistor and a control terminal of the eighth transistor are electrically connected to a sixth node, a first terminal of the seventh transistor is electrically connected to the third clock signal terminal, a second terminal of the seventh transistor is electrically connected to a first terminal of the eighth transistor, and a second terminal of the eighth transistor is electrically connected to a fourth node, the ninth transistor has a control terminal electrically connected to the third clock signal terminal, a first terminal electrically connected to the second low level signal terminal and a second terminal electrically connected to the fourth node, the tenth transistor has a control terminal electrically connected to the fourth node, a first terminal electrically connected to the second clock signal terminal and a second terminal electrically connected to a fifth node, the eleventh transistor has a control terminal electrically connected to the second clock signal terminal, a first terminal electrically connected to the fifth node and a second terminal electrically connected to the second node, the twelfth transistor has a control terminal electrically connected to the first node, a first terminal electrically connected to the high level signal terminal and a second terminal electrically connected to the second node, the thirteenth transistor has a control terminal electrically connected to the first clock signal terminal, a first terminal electrically connected to the input signal terminal and a second terminal electrically connected to the sixth node, the second capacitor has a first terminal electrically connected to the high level signal terminal and a second terminal electrically connected to the second node, wherein a low level of the first clock signal is equal to a low level of the third low level signal, and the low level of the first clock signal, a low level of the third clock signal and a threshold voltage of the ninth transistor satisfy a relation that the low level of the first clock signal is greater than a sum of the low level of the third clock signal and an absolute value of the threshold voltage of the ninth transistor, and wherein the emission driving circuit further comprises a third signal line and a fourth signal line, the third clock signal terminal of a shift register at each odd-numbered stage of the plurality of cascaded shift registers is electrically connected to the third signal line, and the third clock signal terminal of a shift register at each even-numbered stage of the plurality of cascaded shift registers is electrically connected to the fourth signal line.

14. The emission driving circuit according to claim 12, wherein the input signal terminal of a shift register at a $n^{th}$ stage of the plurality of cascaded shift registers is electrically connected to the output terminal of a shift register at a $(n-1)^{th}$ stage of the plurality of cascaded shift registers, wherein n is from 2, 3, 4, . . . , or N, N being a number of the plurality of cascaded shift registers in the emission driving circuit.

15. A display device, comprising an emission driving circuit comprising a first signal line, a second signal line, and a plurality of cascaded shift registers, wherein each shift register of the plurality of cascaded shift registers comprises:

a first node control module electrically connected to an input signal terminal, a first low level signal terminal, a first clock signal terminal, a second clock signal terminal and a high level signal terminal, and configured to control a level at a first node based on an input signal, a first low level signal, a first clock signal, a second clock signal and a high level signal;

a second node control module electrically connected to a second low level signal terminal, the first clock signal terminal, the second clock signal terminal, a third clock signal terminal, the high level signal terminal and the first node, and configured to control a level at a second node based on a second low level signal, the first clock signal, the second clock signal, a third clock signal, the high level signal and the level at the first node; and an output control module electrically connected to the high level signal terminal, a third low level signal terminal, the first node and the second node, and configured to control an output terminal to output the high level signal or a third low level signal based on the high level signal, the third low level signal, the level at the first node and the level at the second node, wherein the output control module comprises a transistor for outputting a low level, and the transistor is a PMOS transistor having a control terminal electrically connected to the first node, a first terminal electrically connected to the third low level signal terminal and a second terminal electrically connected to the output terminal, wherein when the first low level signal provides a low level at the first node and the high level signal provides a high level at the second node, the low level at the first node controls the transistor to output a low level in the output control module such that the output terminal outputs the third low level signal, wherein the first low level signal, the third low level signal and a threshold voltage of the transistor for outputting low level in the output control module satisfy a relation that the third low level signal is greater than a sum of the first low level signal and an absolute value of the threshold voltage, such that in a phase following the output terminal outputting the high level signal, the output terminal completely outputs the third low level signal, wherein the first clock signal terminal of a shift register at each odd-numbered stage of the plurality of cascaded shift registers and the second clock signal terminal of a shift register at each even-numbered stage of the plurality of cascaded shift registers are both electrically connected to the first signal line, and wherein the second clock signal terminal of a shift register at each odd-numbered stage of the plurality of cascaded shift registers and the first clock signal terminal of a shift register at each even-numbered stage of the plurality of cascaded shift registers are both electrically connected to the second signal line.

16. A driving method of a shift register, applicable in an emission driving circuit, comprising a shift register, wherein the shift register comprises:

a first node control module electrically connected to an input signal terminal, a first low level signal terminal, a first clock signal terminal, a second clock signal terminal and a high level signal terminal, and configured to control a level at a first node based on an input signal, a first low level signal, a first clock signal, a second clock signal and a high level signal;

a second node control module electrically connected to a second low level signal terminal, the first clock signal terminal, the second clock signal terminal, a third clock signal terminal, the high level signal terminal and the first node, and configured to control a level at a second node based on a second low level signal, the first clock signal, the second clock signal, a third clock signal, the high level signal and the level at the first node; and an output control module electrically connected to the high level signal terminal, a third low level signal terminal, the first node and the second node, and configured to control an output terminal to output the high level signal or a third low level signal based on the high level signal, the third low level signal, the level at the first node and the level at the second node, wherein the output control module comprises a transistor for outputting a low level, and the transistor is a PMOS transistor having a control terminal electrically connected to the first node, a first terminal electrically connected to the third low level signal terminal and a second terminal electrically connected to the output terminal, wherein when the first low level signal provides a low level at the first node and the high level signal provides a high level at the second node, the low level at the first node controls the transistor to output a low level in the output control module such that the output terminal outputs the third low level signal, and wherein the first low level signal, the third low level signal and a threshold voltage of the transistor for outputting low level in the output control module satisfy a relation that the third low level signal is greater than a sum of the first low level signal and an absolute value of the threshold voltage, such that in a phase following the output terminal outputting the high level signal, the output terminal completely outputs the third low level signal, wherein the driving method comprises:

in a first phase when the input signal is at a high level, the first clock signal is at a low level, the second clock signal is at a high level and the third clock signal is at a low level, providing, by the first node control module, a high level at the first node, providing, by the second node control module, a high level at the second node, and maintaining, by the output control module, the output terminal at a low level outputted in a previous phase;

in a second phase when the input signal is at a low level, the first clock signal is at a high level, the second clock signal is at a low level and the third clock signal is at a high level, maintaining, by the first node control module, the first node at the high level in the first phase, providing, by the second node control module, a low level at the second node, and controlling, by the output control module, the output terminal to output the high level signal;

in a third phase when the input signal is at the low level, the first clock signal is at a low level, the second clock signal is at a high level and the third clock signal is at a low level, providing, by the first node control module, a low level at the first node, providing, by the second node control module, a high level at the second node, and controlling, by the output control module, the output terminal to completely output the third low level signal; and in a fourth phase when the input signal is at a low level, the first clock signal is at a high level, the second clock signal is at a low level and the third clock signal is at a high level, maintaining, by the first node control module, the first node at the low level in the third phase, providing, by the second node control module, a high level at the second node, and maintaining, by the output control module, the output terminal at the low level outputted in the third phase.

* * * * *